United States Patent [19]

McEuen et al.

[11] 4,146,817

[45] Mar. 27, 1979

[54] STANDING WAVE LINEAR ACCELERATOR AND SLOTTED WAVEGUIDE HYBRID JUNCTION INPUT COUPLER

[75] Inventors: Albert H. McEuen, Saratoga; Victor A. Vaguine, Palo Alto, both of Calif.

[73] Assignee: Varian Associates, Inc., Palo Alto, Calif.

[21] Appl. No.: 777,220

[22] Filed: Mar. 14, 1977

[51] Int. Cl.[2] ..... H01J 25/10

[52] U.S. Cl. ..... 315/5.41; 315/5.42; 333/208; 333/120

[58] Field of Search ..... 315/5.41, 5.42; 333/10, 333/11

[56] References Cited

U.S. PATENT DOCUMENTS

| | | | |
|---|---|---|---|
| 2,709,241 | 5/1955 | Riblet | 333/10 X |
| 2,739,287 | 3/1956 | Riblet | 333/10 X |
| 3,546,524 | 12/1970 | Stark | 315/5.42 |
| 3,758,879 | 9/1973 | Beguin et al. | 333/11 |
| 3,906,300 | 9/1975 | Tran | 315/5.42 |
| 4,024,426 | 5/1977 | Vaguine | 315/5.41 |

*Primary Examiner*—Saxfield Chatmon, Jr.
*Attorney, Agent, or Firm*—Stanley Z. Cole; Leon F. Herbert

[57] ABSTRACT

A standing-wave linear charged particle accelerator is disclosed which comprises a plurality of interlaced substructures, with each substructure having a plurality of accelerating cavities disposed along the particle beam path and having side cavities disposed away from the beam path for electromagnetically coupling the accelerating cavities. A radio-frequency electromagnetic standing wave is supported in each substructure, with the wave in each substructure being phased with respect to the wave in every other substructure so that the particle beam will experience a maximum energy gain throughout its path through the accelerator. A slotted input coupler is connected to the accelerator to individually drive each of the substructures.

6 Claims, 6 Drawing Figures

STANDING WAVE LINEAR ACCELERATOR AND SLOTTED WAVEGUIDE HYBRID JUNCTION INPUT COUPLER

CROSS-REFERENCE TO RELATED APPLICATIONS

This is a further advance in the accelerator art disclosed in U.S. applications of Victor Vaguine, Ser. No. 420,754, filed Nov. 30, 1973, now abandoned, and Ser. No. 754,650, filed Dec. 27, 1976.

BACKGROUND OF THE INVENTION

This invention is a further development in the side-cavity coupled accelerator art described by E. A. Knapp, B. C. Knapp and J. M. Potter in an article entitled "Standing Wave High Energy Linear Accelerator Structures", 39 *Review of Scientific Instruments* 979 (1968); and as further described in U.S. Pat. No. 3,546,524 to P. G. Stark. More specifically, the invention provides an improvement in the drive coupling for the interlaced arrangement of side-cavity coupled substructures as described in said related applications.

SUMMARY OF THE INVENTION

The accelerating cavities of two independent side-cavity coupled substructures are interlaced to form a single overall accelerator structure, with each substructure being energized with radio-frequency power in phased relation with the other substructure. This arrangement permits operation at higher power levels without radio-frequency breakdown, and increases the portion of the beam path along which the beam is acted upon by the radio-frequency field, as compared to single-substructure side-cavity coupled accelerators such as disclosed in the above-mentioned article by Knapp et al. Each substructure is preferably operated in the $\pi/2$ mode. The $\pi/2$ mode means each side cavity is 90 degrees out of phase with each of the accelerating cavities to which it is coupled, and adjacent accelerating cavities in a given substructure are 180 degrees out of phase. The preceding structure is disclosed in said related applications. In the present invention, a slotted input coupler is provided to independently energize each substructure with electro-magnetic wave energy.

One of the objects of this invention is to provide an accelerator comprising interlaced side-cavity coupled substructures having an improved arrangement for coupling input power to the two substructures from a single source.

Another object is to provide an input coupling arrangement which provides an excellent coupling match to each of the substructures to avoid detuning the substructures.

A further object is to provide an input coupling arrangement which provides correct phase relationship between each of the substructures over a relatively broad frequency band.

Another object is to provide an input coupling arrangement, which provides correct power division between the substructures.

An additional object is to provide an input coupling arrangement which causes power reflected back from the substructures to be diverted from the driving source to a dummy load.

Other objects and advantages of this invention will be apparent upon a reading of the following specification in conjunction with the accompanying drawing.

DESCRIPTION OF A PREFERRED EMBODIMENT

Figures 1, 2, 6:
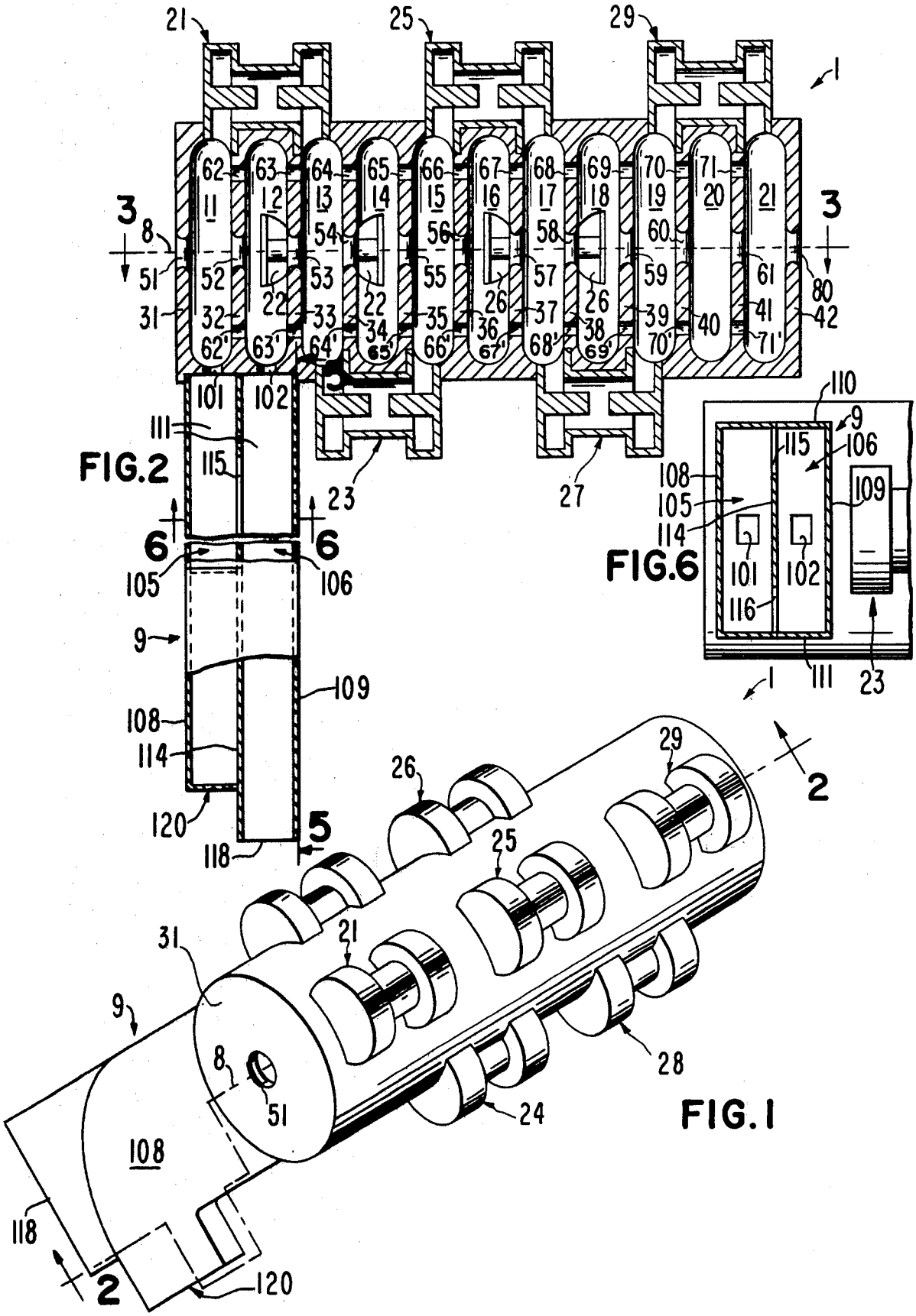
FIG. 1 is an oblique view of a standing-wave linear particle accelerator having two independent side-cavity coupled substructures interlaced according to this invention.
FIG. 2 is a sectional view of the accelerator taken on line 2—2 of FIG. 1.
FIG. 6 is a cross section through the input coupler taken on line 6—6 in FIG. 2.

FIG. 1 shows an oblique view of a preferred embodiment of a standing-wave linear particle accelerator according to the teaching of this invention. The accelerator 1 has two interlaced side-cavity coupled standing-wave substructures with the side cavities of each substructure being disposed orthogonally with respect to the side cavities of the other substructure along a common axis 8. The axis 8 also defines the path of the charged particle beam through the accelerator 1. Each substructure comprises a series of accelerating cavities, with the accelerating cavities of one substructure being interlaced with the accelerating cavities of the other substructure as will be discussed in connection with FIGS. 2 and 3. For each substructure, the accelerating cavities are inductively coupled by side cavities. The side cavities are seen in FIG. 1 as projections from the generally cylindrical overall configuration of the accelerator 1. The accelerating cavities of one substructure, however, are electromagnetically discoupled from the accelerating cavities of the other substructure.

Also shown in FIG. 1 is a radio-frequency power input coupler in the form of a slotted hybrid waveguide 9 for energizing, respectively, each of the standing-wave substructures. The input coupler will be hereinafter described in detail. A conventional charged particle source, e.g., an electron gun, not shown, injects a beam of charged particles through a beam entrance aperture 51 into the accelerator 1 along axis 8 from left to right as viewed in FIGS. 1, 2 and 3. The charged particles which are in phase with the accelerating field in the first accelerating cavity are captured and bunched. The formed bunch of the charged particles will pass through each successive accelerating cavity during a time interval when the accelerating electric field intensity in that cavity is a maximum if the phasing between substructures is correctly selected as will be hereinafter described.

Figure 3:
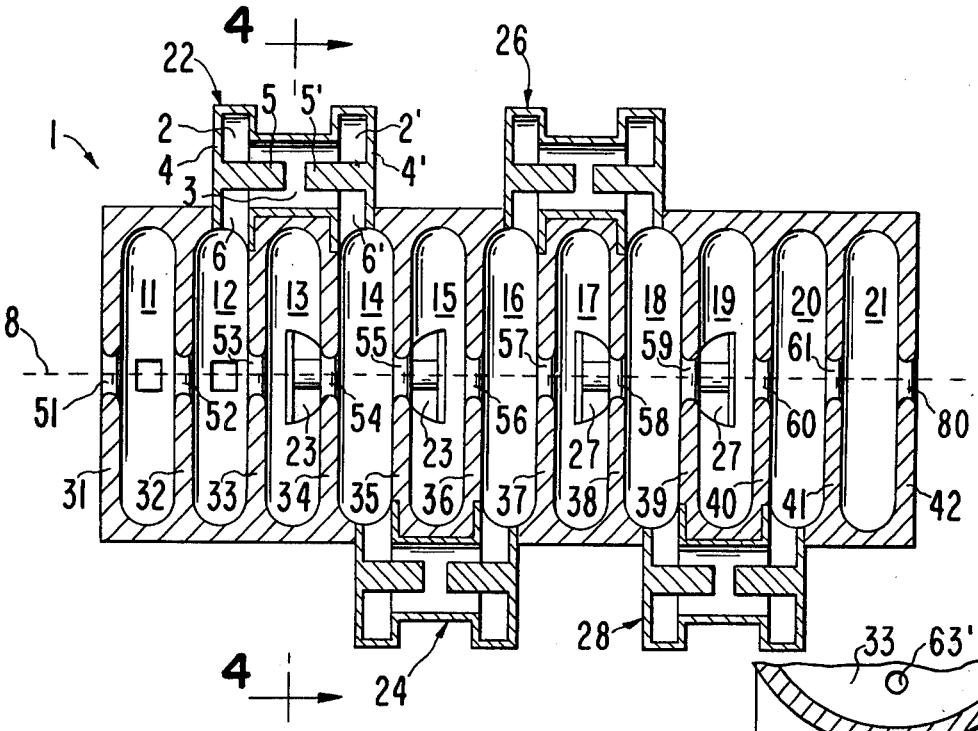
FIG. 3 is a sectional view of the accelerator taken on line 3—3 of FIG. 2.

FIG. 2 shows a cross-sectional view of accelerator 1 along the axis 8 of the particle beam. In the particular embodiment shown, there are eleven accelerating cavities 11, 12, 13, 14, 15, 16, 17, 18, 19, 20, 21. The odd-numbered accelerating cavities (11, 13, 15, 17, 19 and 21) are electrically coupled together by side cavities 21, 23, 25, 27 and 29 to form one standing wave substructure. FIG. 3 shows another cross-sectional view of accelerator 1 along the axis 8 of the particle beam, orthogonal to the cross-sectional view of FIG. 2. In FIG. 3, the even-numbered accelerating cavities (12, 14, 16, 18 and 20) are shown electrically coupled together by side cavities 22, 24, 26 and 28 to form another standing wave substructure. Each of the accelerating cavities 11 through 21 has a cylindrical configuration, and all these accelerating cavities are coaxially aligned along the axis 8.

The first cavity 11 has an entrance wall 31 which extends perpendicular to the beam axis 8 and includes a circular beam entrance aperture 51 disposed coaxially with respect to the beam axis 8. A second wall 32, which also extends perpendicular to the beam axis 8, serves as a common wall between the accelerating cavity 11 and the accelerating cavity 12. The wall 32 also includes a central circular aperture 52 which is coaxially aligned with aperture 51 along the beam axis 8. The two substructures must be capable of operating out of phase with each other so there should not by any significant coupling through the beam aperture 52. If a particular embodiment exhibits undesired coupling through the beam aperture it can be cancelled in a simple manner. Thus in FIG. 2 the common wall 32 additionally includes a pair of magnetic coupling apertures 62 and 62′ which are symmetrically disposed with respect to each other on opposite sides of the central aperture 52. These magnetic coupling apertures are located near the outer periphery of the wall 32, adjacent the regions in cavities 11 and 12 where the magnetic field approaches a maximum value and the electric field is very small. In principle, magnetic coupling between cavities 11 and 12 could be provided by a single coupling hole or by a plurality of coupling holes arranged, for example, in annular fashion around the outer periphery of wall 32. However, it has been found that the two diametrically opposed coupling holes 62 and 62′ as shown in FIG. 2, of a size on the same order as the size of the central beam aperture 52, will provide adequate magnetic coupling between the adjacent cavities 11 and 12 to compensate for undesirable electric coupling through the central aperture 52. The net effect of the coupling of energy from cavity 11 into cavity 12 through aperture 52 is effectively cancelled by the simultaneous coupling of energy from cavity 12 back into cavity 11 through the magnetic coupling apertures 62 and 62′. As illustrated in FIGS. 2 and 3, the edges of the apertures 51 and 52 are rounded in order to reduce the electric field gradient at these apertures to a lower value than would result if drift tubes or non-rounded iris openings were provided.

The accelerating cavity 12 includes another wall 33 which serves as a common wall between cavity 12 and the next accelerating cavity 13. The wall 33 has a central aperture 53 which is coaxial with the beam axis 8, and a pair of magnetic coupling apertures 63 and 63′ which are symmetrically disposed on opposite sides of the central aperture 53 in order to provide magnetic coupling between cavities 12 and 13 so as to compensate for any electrical coupling between these cavities through central aperture 53. The edges of the aperture 53 are rounded, as discussed above in connection with apertures 51 and 52, to reduce the electric field gradient at the iris openings between adjacent accelerating cavities.

The cavities 13, 14, 15, 16, 17, 18, 19, 20 and 21 include common walls 34, 35, 36, 37, 38, 39, 40 and 41, respectively, disposed between adjacent cavities so that all of the cavities are aligned along the beam axis 8. The common walls 34, 35, 36, 37, 38, 39, 40 and 41 each include one of a plurality of central beam apertures 54, 55, 56, 57, 58, 59, 60 and 61, respectively, which are also coaxially aligned with each other about the beam axis 8. Each of the walls 34, 35, 36, 37, 38, 39, 40 and 41 additionally includes a pair of magnetic coupling apertures 64 and 64′, 65 and 65′, 66 and 66′, 67 and 67′, 68 and 68′, 69 and 69′, 70 and 70′, and 71 and 71′, respectively, which are symmetrically disposed on opposite sides of the central apertures 54, 55, 56, 57, 58, 59, 60 and 61, respectively, and serve to magnetically couple the adjacent accelerating cavities 13 and 14, 14 and 15, 15 and 16, 16 and 17, 17 and 18, 18 and 19, 19 and 20, and 20 and 21, respectively. This magnetic coupling of adjacent cavities compensates for any electric coupling that occurs through the central beam apertures in the walls separating the adjacent cavities. The beam apertures 54, 55, 56, 57, 58, 59, 60 and 61 are likewise rounded to reduce the electric field gradient at the iris openings between adjacent accelerating cavities. An exit wall 42 having a central beam exit aperture 80 aligned with the beam axis 8 is disposed on the opposite side of the accelerating cavity 21 from the wall 41 and serves to complete the accelerating cavity structure. It is noted that the accelerator 1 is an evacuated structure. For the embodiment shown in the drawing, it is necessary that the beam entrance aperture 51 and beam exit aperture 80 be covered by windows which are impermeable to gas in order that vacuum-tight integrity of the structure can be maintained yet which are permeable to the beam particles at the energies at which these particles respectively enter into or exit from the accelerator 1. An alternative arrangment with respect to the beam entrance aperture 51 is to dispose a preaccelerator structure, or the charged particle source, immediately adjacent the aperture 51, such as by a vacuum-tight flange connection, in such a way that charged particles could be injected directly through aperture 51 into the evacuated accelerator 1 without the necessity of any window material covering the aperture 51. In an x-ray device the closure wall for aperture 80 would carry an x-ray generating target to be struck by the beam passing through aperture 80. If the accelerator is used only for charged particles that can be collimated into a very narrow beam, it is possible for the central beam apertures to be made so small that electrical coupling between adjacent accelerating cavities will be negligible. In that case, the magnetic coupling apertures are unnecessary and can be eliminated.

The accelerating cavity 11 is inductively coupled through a side cavity 21 to the accelerating cavity 13, as shown in FIG. 2. A second side cavity 22, as shown in FIG. 3, is disposed ninety degrees around the beam axis 10 from side cavity 21 and provides similar inductive coupling between the two accelerating cavities 12 and 14. A third side cavity 23, as shown in FIG. 2, is disposed ninety degrees around the beam axis 8 beyond side cavity 22 and provides coupling between the two accelerating cavities 13 and 15. A fourth side cavity 24 is disposed ninety degrees around the beam axis 8 beyond side cavity 23 and provides coupling between the two accelerating cavities 14 and 16. In a like manner, a fifth side cavity 25 is disposed ninety degrees around the beam axis 8 beyond side cavity 24, in alignment with the side cavity 21, and provides coupling between the two accelerating cavities 15 and 17. Similarly, a sixth side cavity 26 is disposed ninety degrees around the beam axis 8 beyond side cavity 25, in alignment with the side cavity 22, and provides coupling between the two accelerating cavities 16 and 18. A seventh side cavity 27 is disposed an additional ninety degrees around the beam axis 8, in alignment with the side cavity 23, and provides coupling between the accelerating cavities 17 and 19. Similarly, an eighth side cavity 28 is disposed an additional ninety degrees around the beam axis 8 beyond side cavity 27, in alignment with the side cavity 24, and provides coupling between the two accelerating cavities 18 and 20. A ninth side cavity 29 is disposed ninety degrees further around the beam axis 8, in alignment with side cavities 21 and 25, and provides coupling between the two accelerating cavities 19 and 21.

Figure 4:
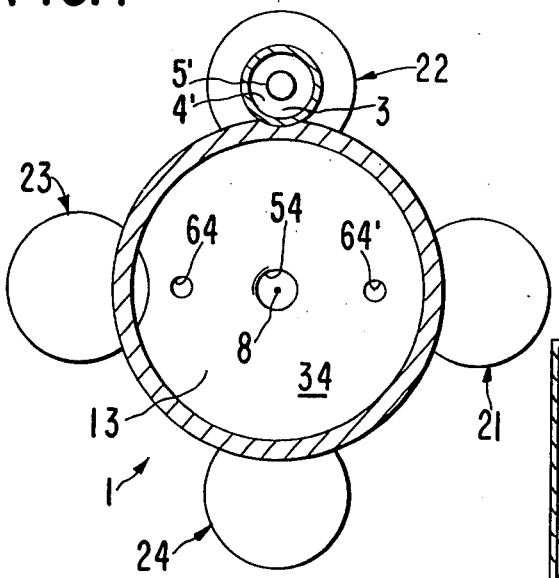
FIG. 4 is a sectional view of an accelerating cavity of the accelerator taken on line 4—4 of FIG. 3.

In principle, the side cavities 21 through 29 could be configured in the conventional manner as illustrated, for example, in the aforesaid article by E. A. Knapp, et al. It is preferable, however, to modify the conventional configuration of the side cavities in order to accomodate the interposition between each pair of coupled accelerating cavities of an independently energized accelerating cavity. Thus, the configuration of side cavity 22 is designed, as best shown in FIG. 3, to accomodate the interposition of accelerating cavity 13 between the accelerating cavities 12 and 14 which are electrically coupled by the side cavity 22. In particular, cavity 22, instead of being configured as a single cylinder according to the conventional manner, is configured as a combination of three coaxial cylinders 2, 3 and 2'. One end of cylinder 2 is partially bounded by wall 4, and the other end is in open communication with cylinder 3. Cylinder 3 is coaxial with but of smaller diameter than cylinders 2 and 2', and is in open communication at each end with cylinders 2 and 2' to form the interior chamber of the side cavity 22. Cylinder 2' has the same diameter and axial length as cylinder 2, and is partially bounded by wall 4' on the end opposite cylinder 3. The axial length of cylinder 3 is equal to the distance between the outside surfaces of walls 33 and 34 of the accelerating cavity 13, as seen in FIG. 3. The diameter of cylinder 3 is less than the diameter of cylinders 2 and 2' by an amount sufficient to permit cylinders 2 and 2' to have a conventionally determined diameter while allowing accelerating cavity 13 to be coaxial with and to have the same dimensions as accelerating cavities 12 and 14. Metal post 5 projecting from wall 4 and metal post 5' projecting from wall 4' are symmetrically disposed along the common axis of cylinders 2, 3, and 2' whereby the gap between posts 5 and 5' can provide the capacitance necessary for tuning the side cavity 22 to the same frequency as the accelerating cavities 12 and 14. FIG. 4 shows in detail a cross-sectional view through accelerating cavity 13 and side cavity 22. Side cavity 22 communicates with accelerating cavity 12 through iris 6 and with accelerating cavity 14 through iris 6', where irises 6 and 6' are inductive coupling irises. The other side cavities 24, 26 and 28 shown in FIG. 3, and the side cavities 21, 23, 25, 27 and 29 shown in FIG. 2, are constructed in the same manner as described above for side cavity 22. The accelerating cavities and the side coupling cavities of a particular substructure are all tuned to be resonant at essentially the same frequency. For practical application it is contemplated that the cavities will be resonant at S-band.

Figure 5:
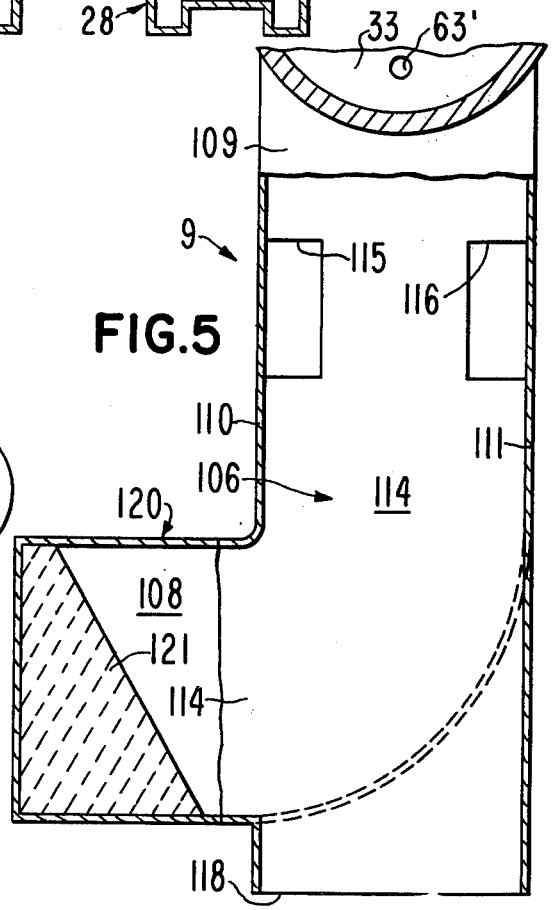
FIG. 5 is a side elevational view of the input coupler taken on line 5—5 of FIG. 2 but showing the side wall mostly broken away to show an interior common wall.

As shown in FIGS. 2, 5 and 6, the two substructures are driven by a radio-frequency power input coupler in the form of a 3-db slotted hybrid waveguide 9 connected to accelerating cavities 11 and 12 through coupling irises 101 and 102 respectively. Basically the coupler 9 comprises adjacent waveguide passages 105 and 106 formed by broad walls 108, 109; relatively narrow walls 110, 111; and common wall 114. The common wall 114 is provided with one or more slots such as slots 115 and 116. The outward end of waveguide passage 106 forms an inlet port 118 for the introduction of radio frequency power from a conventional RF source not shown. The outward end of waveguide passage 105 is preferably bent at right angles to form an RF load section 120 containing a dummy load in the form of a tapered lossy ceramic block 121. The operation of the above described input coupler is such that RF power introduced at port 118 divides equally at slots 115 and 116 to drive each of the cavities 11 and 12. The slotted arrangement operates to cause the electromagnetic wave through iris 102 to be 90 degrees out of phase with the electromagnetic wave through iris 101 so that cavities 11 and 12 are driven 90 degrees out of phase. In the event any problem occurs to cause power to be reflected back from the substructures it is diverted by the coupler structure from reaching inlet port 118 and is all transmitted to the dummy load section 120 and thus protects the RF driving source from damage. The design of specific hybrid junctions such as coupler 9 is well known in the waveguide junction art as taught for example in H. J. Riblet, "The Short-slot Hybrid Junction," Proc. I.R.E., V. 40, pp. 180–184 (February 1952); E. Hadge, "Compact Top-Wall Hybrid Junction", IRE Trans. Microwave Theory & Technique, V. 1, pp. 29–30 (1953); R. Levy, "Directional Couplers" (in Advances in Microwaves, V. 1), 1966, for example, pp. 150–152.

As previously stated, the standing wave substructure comprised of the odd numbered accelerating cavities 11, 13, 15, 17, 19 and 21 and side cavities 21, 23, 25, 27 and 29, is not coupled to the standing wave substructure comprised of the even numbered accelerating cavities and even numbered side cavities, so the substructures can be driven out of phase with each other. Also as previously mentioned, each of the substructures operate in the $\pi/2$ mode so that adjacent accelerating cavities in the odd numbered substructure, such as cavities 11 and 13, are 180 degrees out of phase, and adjacent accelerating cavities in the even numbered substructure, such as cavities 12 and 14, are also 180 degrees out of phase. The adjacent accelerating cavities in each substructure are spaced along the beam path such that a charged particle which received maximum acceleration in one cavity in the substructure (such as cavity 11) will be in every other cavity in the same substructure (such as cavity 13) when the field therein is delivering maximum acceleration. Since adjacent accelerating cavities wihin each of the independent substructures are 180 degrees out of phase, it is necessary that the phase shift between the accelerating cavities of one substructure and the adjacent accelerating cavities of the other substructure be 90 degrees. In other words, if the beam travels from accelerating cavity 11 to accelerating cavity 13 in the time required for a phase shift of 180 degrees, it will travel half the distance, that is from accelerating cavity 11 to accelerating cavity 12, in half the time, and thus the phase shift between accelerating cavities 11 and 12 for maximum acceleration must be half the phase shift between accelerating cavities 11 and 13. Thus, the substructures must be driven 90 degrees out of phase and such phasing is provided by the input coupler 9.

Although this invention has been described with respect to preferred embodiments, it will be readily apparent to those skilled in the art that various changes in form and arrangement of parts may be made to suit requirements without departing from the spirit and scope of the invention as defined by the following claims.

What is claimed is:

1. An accelerator for charged particle beams comprising wall means forming a plurality of adjacent accelerating cavities, beam-passage apertures formed in said wall means between adjacent accelerating cavities, coupling means spaced from said beam-passage apertures and interconnecting every other accelerating cavity to form two accelerating substructures, and a power input coupler separately connected to said two accelerating substructures, said input coupler comprising a waveguide hybrid junction having two adjacent waveguide sections having a common wall with a coupling slot in said wall, one end of one of said waveguide sections being connected to one of said two accelerating substructures, and one end of the other of said two waveguide sections being connected to the other of said two accelerating substructures.

2. An accelerator as claimed in claim 1 wherein said input coupler is connected to accelerating cavities which are adjacent to each other.

3. An accelerator as claimed in claim 1 wherein said coupling means comprises resonant coupling cavities external to said accelerating cavities.

4. An accelerator as claimed in claim 3 wherein said input coupler divides the input wave into two waves ninety degrees out of phase with each other.

5. An accelerator as claimed in claim 1 wherein said input coupler has a rectangular internal cross-section, said common wall being joined to two opposite parallel walls of said rectangular cross-section, said common wall has two coupling slots therein, one of said slots being located adjacent one of said opposite walls, and the other of said slots being located adjacent the other of said opposite walls.

6. An accelerator as claimed in claim 1 wherein the other end of one of said waveguide sections is connected to a dummy load.

* * * * *